United States Patent [19]

Nielsen, Jr.

[11] 4,058,992

[45] Nov. 22, 1977

[54] BARREL TYPE LOCK AND KEY

[76] Inventor: Anker J. Nielsen, Jr., 410 Bailey Road, Holden, Mass. 01520

[21] Appl. No.: 708,837

[22] Filed: July 26, 1976

[51] Int. Cl.[2] ..... E05B 67/36

[52] U.S. Cl. ..... 70/34; 70/386

[58] Field of Search ..... 70/32–34, 70/38 C; 285/315, 322; 403/141, 142, 289, 290; 279/51, 50, 89, 103; 408/240, 239; 90/11 D; 24/211 N

[56] References Cited

U.S. PATENT DOCUMENTS 3,446,045 5/1969 Finck ..... 70/34

3,868,886 3/1975 Bondie ..... 90/11 D

*Primary Examiner*—Robert L. Wolfe

*Attorney, Agent, or Firm*—Robert K. Randall

[57] ABSTRACT

The present is an improved form of barrel type lock in which positive contracting mechanical gripping engagement between the key and the spring-biased locking plunger of the lock replaces the expanding frictional type of engagement hitherto used. This change both greatly increases the power of the key to operate weathered or otherwise recalcitrant locks and also provides for different series of locks of the same standard construction which will be operable exclusively by their own particular key.

8 Claims, 14 Drawing Figures

BARREL TYPE LOCK AND KEY

This invention is an improvement in barrel type locks of the construction shown in U.S. Pat. Nos. 3,714,802 to Morse and Nielsen, Jr., and 3,835,674 to Hoyt widely used by gas and electric public service companies for shut-off valves, electric meters, switches, and other devices desired to be operated solely by authorized personnel. In the commonest type as in these patents, the unlocking engagement between the key and the plunger which controls the locking elements is effected by expanding the end of the key within a cylindrical bore in the plunger to create a frictional grip capable of retracting the plunger and releasing the locking balls. This type of engagement does not readily admit of being varied to distinguish keys used by the gas companies from those employed by the electric services, for instance, to the displeasure of both industries.

However, by replacing the previous expanding engagement between the key and the plunger by elements on the key contracting to a spaced relation less than the diameter of the opposing end of the plunger after passing beyond and thus embracing the notched or knobbed end thereof, a mechanically positive gripping engagement between the key and the plunger is attained. This grip is capable of overcoming substantially all foreseeable jamming of the plunger in the lock barrel as a result of exposure of the lock to weathering, and also admits of easily varying the shape of the gripping jaws and the mating end of the plunger to confine the lock's response solely to its proper key alone.

An illustrative embodiment of the invention is shown in the accompanying drawings in which FIG. 1 shows in longitudinal axial section a Morse and Hoyt type lock and its key of common form, modified in accordance with the invention principle.

Figure 9:
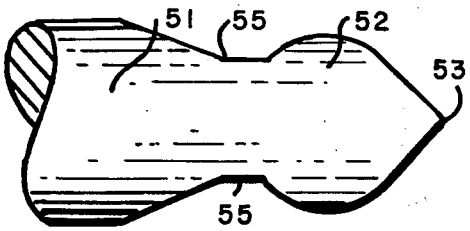
Figure 10:
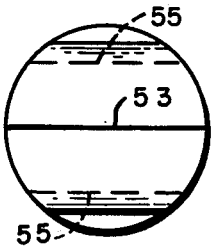
Figure 11:
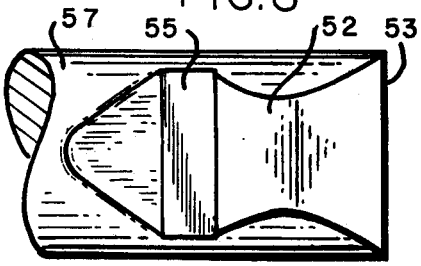

FIGS. 9, 10, and 11 are enlarged plan, end, and side views, respectively, of a different form of knobbed end of the plunger.

Figure 12:
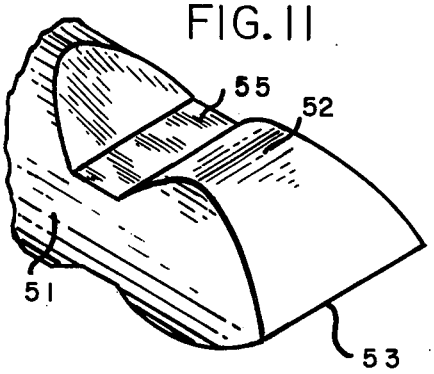

FIG. 12 is an isometric view of the latter knobbed end.

Figure 13:
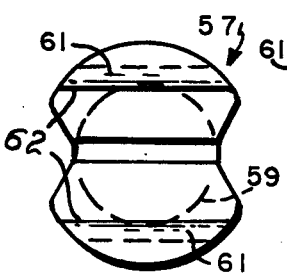
Figure 14:
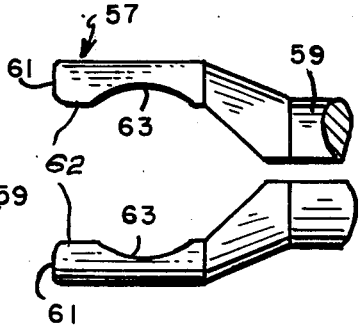

FIGS. 13 and 14 are respectively end and side elevation of the grasping element to mate with the plunger end of FIGS. 9 to 12.

Having reference to the drawings,

The outward parts of the lock are made as heretofore in common practice, comprising a barrel 1, fixed cap 3, and loose cap 5. Likewise, the key is of mainly usual construction so far as its barrel 7, fixed cap or head 9, and plunger 11 actuated manually by cam lever 13 are concerned.

Figure 2:
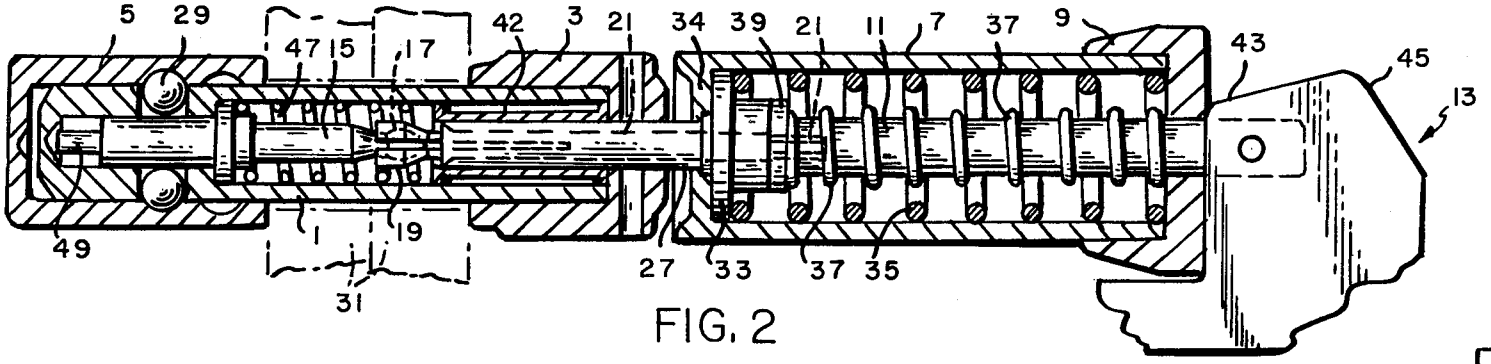
FIG. 2 is a similar section of the same parts in the initial stage of the unlocking operation.
Figure 3:
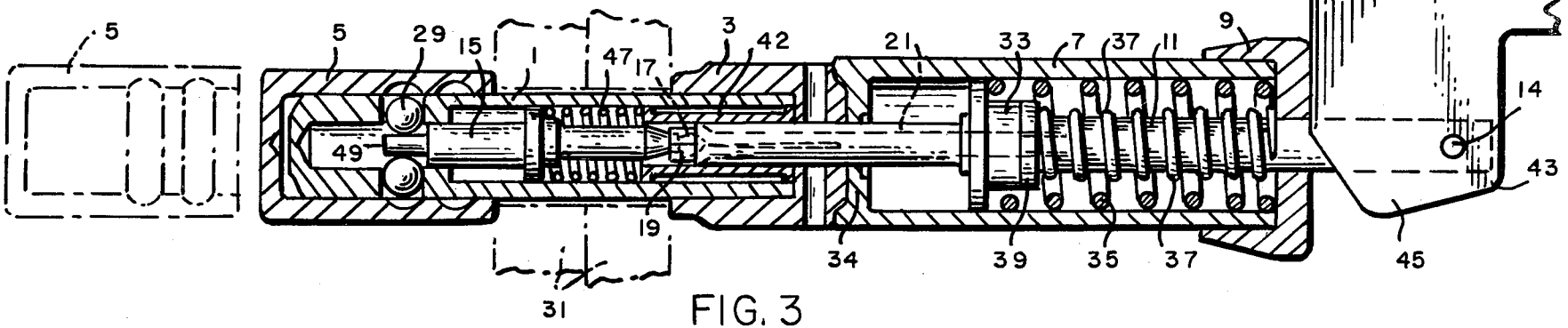
FIG. 3 shows the same in unlocked relation.
Figure 4:
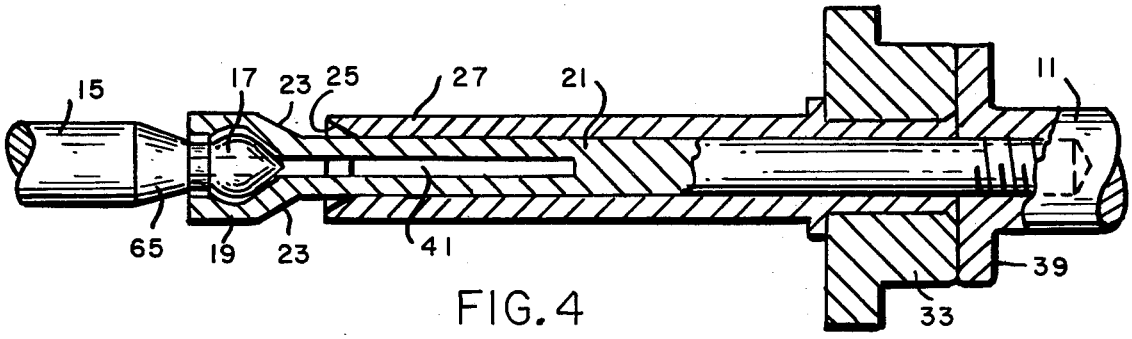
FIG. 4 shows in enlarged axial section the first stage of the engagement between the grasping element of the key and the knobbed end of the plunger in the lock.

In accordance with the invention, in the lock a novel plunger 15 ending in a knob 17 in one form of rounded, pointed or pear-shaped contour is provided to be grasped by a chuck 19 of conforming inner contour on the split resilient end of a slim shaft 21 fixed in the end of plunger 11 of the key, as shown in FIGS. 2 and 4. Thus, when the key is inserted into the lock and the knob enters the chuck, manual rotation of cam lever 13 about its pivot 14 first draws the beveled shoulders 23 of the chuck 19 into the beveled mouth 25 of a sleeve 27 around shaft 21 to clamp the chuck 19 shut on the knob 17, and then draws plunger 15 far enough axially of barrel 1 to let the locking balls 29 recede and thus unlock the cap 5, which can be removed as shown in FIG. 3.

The lock can then be withdrawn from the respectively fixed and movable parts 31 or the like.

The sleeve 27 is fixed in a bushing 33 having a flange slidable in the bore of the barrel 7 of the key, the sleeve itself being slidable through the end-wall 34 of barrel 7. A stiff spring 35 holds the flange of 33 against the end-wall 34 and the sleeve fully extended, and a second, weaker, spring 37 holds the shaft 21 thrust outwardly by engagement with a flange 39 on the end of plunger 11 into which the end of shaft 21 is screwed. The slot 41 in this shaft gives the jaws 19 the necessary resilience to admit and then close on the knob 17. A guide sleeve 42 directs the chuck jaws over the knob 17; it also makes it harder to move the plunger by a hook of any sort compressing the spring 47 and thus releasing the plunger 15, in case such attempt is made to pick the lock.

Figure 1:
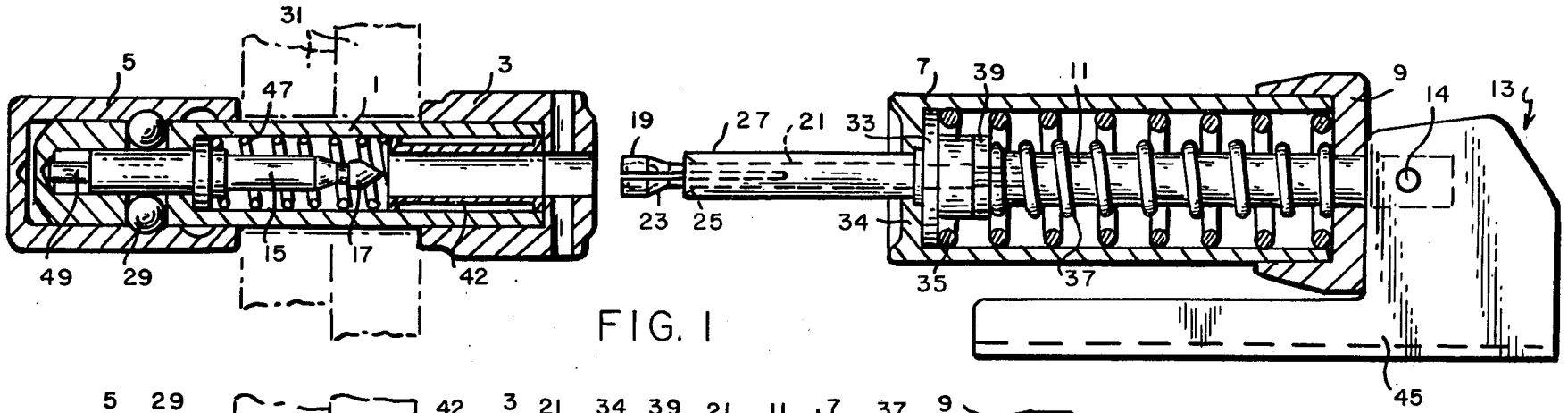
Figure 5:
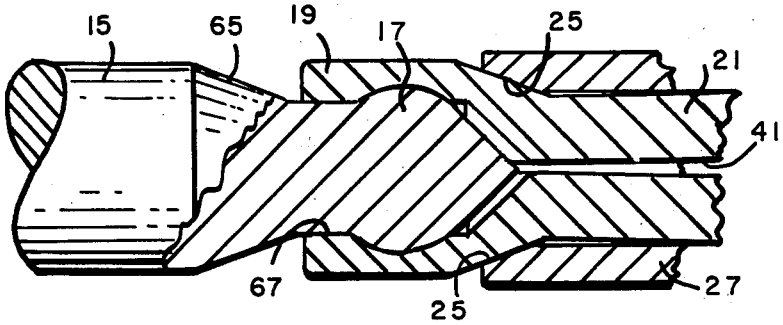
FIG. 5 is a still further enlarged sectional view of the parts of FIG. 4 after the grasp is completed.
Figure 6:
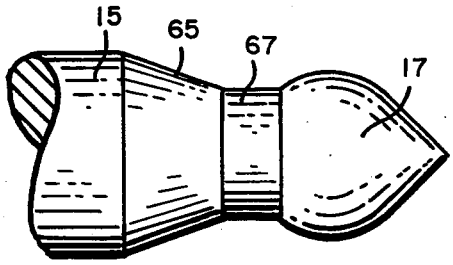
FIG. 6 is a side elevation of the knobbed end of the plunger on the scale of FIG. 5.
Figure 7:
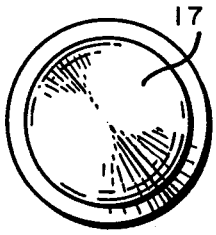
FIG. 7 is an end view of the knobbed end of FIG. 6.
Figure 8:
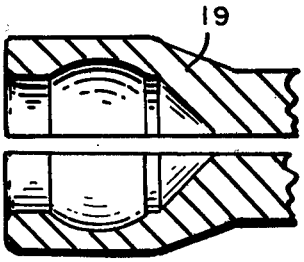
FIG. 8 is a longitudinal axial section of the grasping element of FIGS. 4 and 5.

In actual use, the entry of the chuck 23 and its shaft 21 stops with the concave end-wall 34 of the barrel 7 spaced from the matching end of the fixed cap 3 and the knob in the chuck as shown in FIG. 2, until the lever 13 is moved. As soon as such movement brings the nose 43 of the cam 45 on lever 13 against the cap 9 the barrel 7 moves toward the lock, the cap 3 entering the hollow 34, and the bevel 25 of sleeve 27 sliding over the beveled shoulders 23 of the chuck, clamping it shut FIG. 5. Spring 37 which holds the chuck normally extended as in FIGS. 1 and 2 yields slightly to permit this relative movement of plunger 11.

Continued movement of cam lever 13 counterclockwise bringing cam facets of greater radius against cap 9 draws the plunger 11 and its shaft 21 outwardly of the lock, with the chuck 19 clamped on the knob 17 of the lock's plunger 15. See FIG. 3.

Since the chuck cannot enter the sleeve 27, it pushes this sleeve before it, the stiff spring 35 which bears against the bushing 33 that carries sleeve 27 keeping the chuck 19 jammed tightly in the beveled mouth of the sleeve as the plunger 11 continues its movement in a direction away from the lock.

The lock plunger 15 is thus forced to move against the opposing pressure of its spring 47 until its terminal portion 49 of reduced diameter gets between the locking balls 29, letting them move inward as in FIG. 3 to unlock the cap 5 for removal, and withdrawal of the lock from its locking relation with the elements 31 to permit their relative movement.

Reverse movement of the cam lever 13 returns the parts to the relation of FIG. 2, for separation of the lock from the key, as is obvious.

The invention's feature of a contracting form of actuating engagement between the key and the lock makes possible variant forms of lock and key combinations which are respectively exclusively operable by and solely responsive to one particular pattern of key. An illustration of such is exemplified in FIGS. 9 to 12, wherein the notched end of the lock's plunger 51 of round section terminates in a transverse chisel edge 53 with confluent transverse notches 55 parallel thereto. The mating end 57 of the split key shaft 59, corresponding to shaft 21 of the first form, has a chuck with jaws 61 having opposing part-cylindrical and parallel concavities 63 matching the shape of the knob 52 on the lock's plunger 51 and with the opposed terminal faces 62 of the jaws parallel to each other and to the axis of the two arcs 63 defining the jaws of the clutch 57. In other respects, the key may be constructed as shown in FIGS. 1 to 4, or as desired. Neither key will work on the other's lock.

It is to be noted that the lock's plunger 15 is given a conical taper 65 adjacent the neck 67, to make it more difficult to pick the lock by means driven in through the keyhole and aimed to curl behind the knob and retract the plunger 15.

While I have illustrated and described certain forms in which the invention may be embodied, I am aware that many modifications may be made therein by any person skilled in the art, without departing from the scope of the invention as expressed in the claims.

Therefore, I do not wish to be limited to the particular forms illustrated, but what I do claim is:

1. The combination in a barrel type lock and key therefor of a lock barrel, locking elements protrudible laterally therefrom, a plunger therein for extruding such elements and having a knob on its end, a key having a relatively movable plunger to enter axially into the barrel, means on the latter plunger to make positive contracting gripping engagement with the knob on the plunger which extrudes the locking elements, and cam means for actuating the gripping plunger.

2. The combination according to claim 1 in which the gripping means comprises opposed jaws, and the movement of the gripping plunger locks the jaws shut.

3. The combination according to claim 1 in which the extruding plunger is spring-pressed into extruding relation and a sleeve engaging the spring guides the key's plunger into gripping engagement with the extruding plunger.

4. The combination in a barrel type lock and key therefor of a lock barrel, locking elements protrudible laterally therefrom, a plunger therein to extrude such elements and having an end-portion of reduced diameter back of its end, a key having a relatively movable plunger to enter axially into the barrel, and elements on the latter plunger contracting to a spaced relation to each other less than the diameter of such end-portion after passing beyond and thus embracing the said end-portion of the plunger in the lock and establishing mechanically positive gripping engagement between the key and the plunger of the lock.

5. The combination according to claim 1 in which the plunger in the barrel has a conical taper adjacent the knob.

6. The combination in a barrel type lock and key therefor of a lock barrel with head, locking elements protrudible laterally therefrom, a plunger therein to extrude such elements and having a knob on its end, a key having a barrel to engage the head of the lock, a plunger in the barrel having a shaft slidable through the end of the barrel and the head of the lock and having a split resilient end of inner contour conforming to the knob and forming jaws to grasp the knob, spring means holding the latter plunger yieldingly extended, a sleeve slidable on the shaft and through the end of the barrel into engagement with the jaws to close and hold them closed upon the knob, spring means yieldingly holding the shaft and sleeve extended from the key's barrel, and cam means to retract the shaft and sleeve inwardly of the key's barrel and cause relative movement of the sleeve with respect to the shaft.

7. The combination in a barrel type lock and key therefor of a lock barrel, locking elements protrudible laterally therefrom, a plunger therein for extruding such elements and having a knob on its end, a key having a body and a plunger movable relatively to such body, the plunger having jaws and adapted to enter axially into the lock barrel to make positive contracting gripping engagement of its jaws with the knob, a sleeve slidable on this latter plunger to close the jaws, spring means to resist reverse movement of the sleeve, and cam means to draw the latter plunger inwardly of the body against the resistance of the spring means.

8. The combination according to claim 7 in which the jaws have opposing part-cylindrical parallel concavities and the lock's plunger terminates in a transverse chisel edge with confluent transverse notches parallel to such edge.

* * * * *